US006924074B2

(12) United States Patent
Tomita

(10) Patent No.: US 6,924,074 B2
(45) Date of Patent: Aug. 2, 2005

(54) TONER FOR ELECTROPHOTOGRAPHY, DEVELOPER FOR ELECTROPHOTOGRAPHY USING THE SAME, IMAGE-FORMING PROCESS CARTRIDGE USING THE SAME, IMAGE-FORMING APPARATUS USING THE SAME AND IMAGE-FORMING PROCESS USING THE SAME

(75) Inventor: Kunihiko Tomita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 69 days.

(21) Appl. No.: 10/445,941

(22) Filed: May 28, 2003

(65) Prior Publication Data

US 2003/0224277 A1 Dec. 4, 2003

(30) Foreign Application Priority Data

May 28, 2002 (JP) ..... 2002-154347

(51) Int. Cl.[7] ..... G03G 9/087

(52) U.S. Cl. ..... 430/109.3; 430/108.8; 430/108.4

(58) Field of Search ..... 430/109.3, 108.8, 430/108.4; 399/262

(56) References Cited

U.S. PATENT DOCUMENTS

| | | | | | |
|---|---|---|---|---|---|
| 4,482,621 | A | * | 11/1984 | Kashiwagi | 430/108.21 |
| 5,527,657 | A | | 6/1996 | Takeda et al. | |
| 6,268,099 | B1 | * | 7/2001 | Eguchi et al. | 430/108.8 |
| 6,370,350 | B2 | | 4/2002 | Tomita | |
| 6,370,352 | B1 | | 4/2002 | Tomita | |
| 6,413,690 | B2 | | 7/2002 | Tomita | |
| 6,455,217 | B2 | | 9/2002 | Tomita | |
| 6,492,084 | B2 | * | 12/2002 | Tomita | 430/109.3 |
| 6,505,016 | B2 | | 1/2003 | Tomita | |
| 6,519,439 | B2 | | 2/2003 | Tomita | |
| 2001/0051310 | A1 | * | 12/2001 | Tomita | 430/109.3 |

* cited by examiner

*Primary Examiner*—John L Goodrow
(74) *Attorney, Agent, or Firm*—Oblon, Spivak, McClelland, Maier & Neustadt, P.C.

(57) ABSTRACT

The present invention aims to provide a toner for electrophotography having both good image-fixing properties and good image-reproducibility and image fidelity. The toner contains a coloring agent, a binder resin, and wax. In the toner, the binder resin contains cyclized rubber, the cyclized rubber contains cis1,4-polyisoprene at a portion excluding a cyclized portion of the cyclized rubber. The present invention also provides an image-forming process cartridge, an image-forming apparatus, an image-forming process, each of which utilizes the toner for electrophotography.

18 Claims, 1 Drawing Sheet

FIGURE
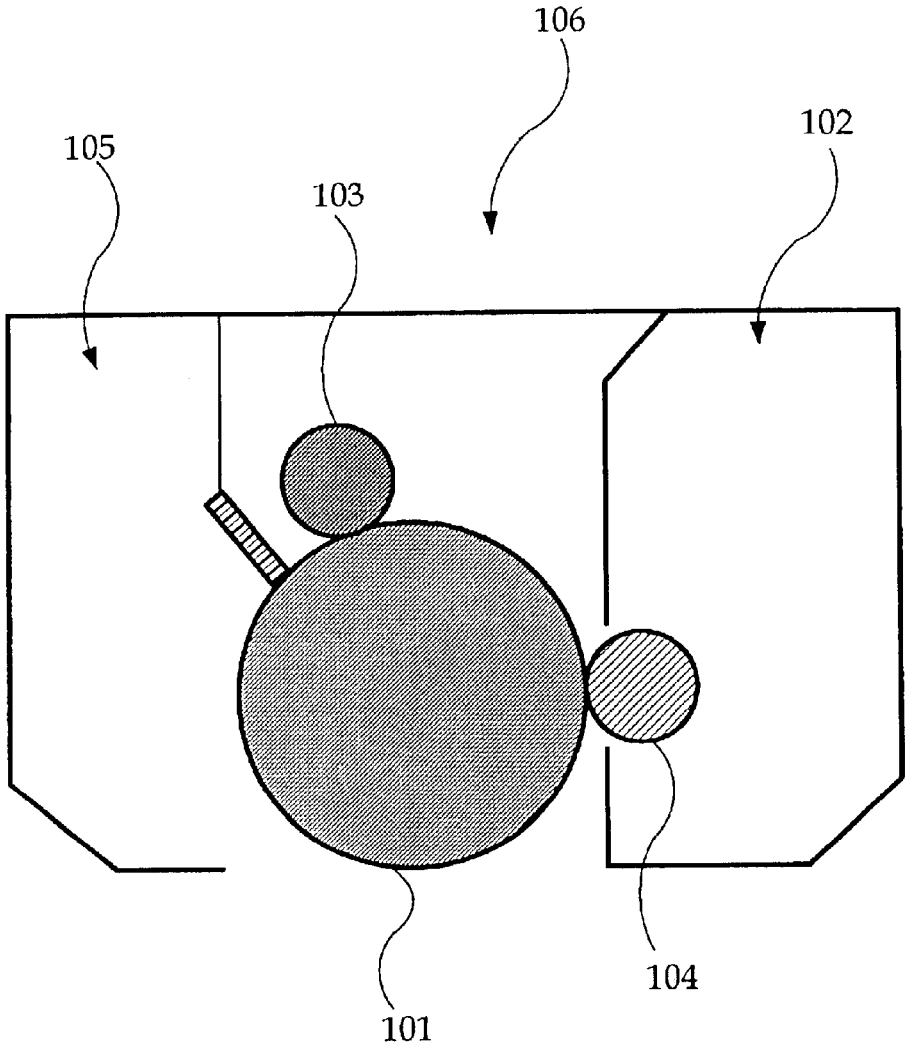

TONER FOR ELECTROPHOTOGRAPHY, DEVELOPER FOR ELECTROPHOTOGRAPHY USING THE SAME, IMAGE-FORMING PROCESS CARTRIDGE USING THE SAME, IMAGE-FORMING APPARATUS USING THE SAME AND IMAGE-FORMING PROCESS USING THE SAME

BACKGROUND OF THE INVENTION

1. Field of the Invention

The present invention relates to a toner for electrophotography, a developer for electrophotography, an image-forming process cartridge, an image-forming apparatus, and an image-forming process, each of which is used for copiers, facsimile machines, and printers.

2. Description of the Related Art

Heat-fixing has been conventionally used for fixing toners. Mechanism of fixing is to nip toners on a recording medium by a fixing roller and a heating roller, to heat and pressurize the toners, to fuse and melt the toners, so that the toners are fixed onto the recording medium. Since the toners are pressurized in addition to being heated, a toner image eventually becomes larger than a latent image which is primarily developed, as the toners are squashed. This is a problem that image-reproducibility of the toners is deteriorated. When only heated sufficiently instead of both heated and pressurized, however, the toners show poor fixing properties such as poor penetration into or poor cohesiveness to a recording medium, although image-reproducibility is improved.

SUMMARY OF THE INVENTION

It is therefore an object of the present invention to solve the problems in the related art, and to provide a toner for electrophotography which enables both good image-fixing and good image-reproducibility, an image-forming process cartridge and an image-forming apparatus, each of which uses the toner.

The following aspects of the present invention can solve the problems in the related art.

The toner for electrophotography of the present invention comprises, in a first aspect, a coloring agent, a binder resin which contains cyclized rubber, and wax. In the toner, the cyclized rubber contains cis1,4-polyisoprene at a portion excluding a cyclized portion of the cyclized rubber.

According to another aspect of the present invention, the cyclized rubber contains 30% or more of the cis1,4-polyisoprene in a number ratio of an isoprene monomer unit at a portion excluding a cyclized portion of the cyclized rubber.

According to another aspect of the present invention, the toner contains 10% by weight or more of the cyclized rubber, relative to the binder resin.

According to another aspect of the present invention, a cyclization degree of the cyclized rubber is 40% or more.

According to another aspect of the present invention, a weight average molecular weight (Mw) of the cyclized rubber is $1\times10^3$ to $5\times10^5$.

According to another aspect of the present invention, the wax is any wax selected from paraffin wax, micro crystalline wax, olefin wax, carnauba wax, candelilla wax, and montan wax.

According to another aspect of the present invention, the wax has a needle penetration of 20 or less at 25° C.

According to another aspect of the present invention, the wax has a melt viscosity of 1 c poise to $10^7$ c poise at 150° C.

According to another aspect of the present invention, the toner for electrophotography of the present invention comprises a coloring agent, a binder resin which contains cyclized rubber, and wax. In the toner of the electrophotography according to the aspect, the cyclized rubber contains cis1,4-polyisoprene at a portion excluding a cyclized portion of the cyclized rubber, the cyclized rubber contains 30% or more of the cis1,4-polyisoprene in a number ratio of an isoprene monomer unit at a portion excluding a cyclized portion of the cyclized rubber, the toner contains 10% by weight or more of the cyclized rubber, relative to a total weight of the binder resin, a cyclization degree of the cyclized rubber is 40% or more, and a weight average molecular weight (Mw) of the cyclized rubber is $1\times10^3$ to $5\times10^5$.

The image-forming process cartridge of the present invention comprises the toner of the present invention.

The image-forming apparatus of the present invention comprises the toner of the present invention.

The image-forming process of the present invention utilizes the toner of the present invention.

BRIEF DESCRIPTION OF THE DRAWING

FIGURE is a schematic view showing an example of the image-forming process cartridge of the present invention.

DESCRIPTION OF THE PREFERRED EMBODIMENTS

For heat-fixing, toners to be fixed need to be either softened or melted by heat of an image-fixing apparatus. The softened or melted toners penetrate into fibers of paper with pressure. A surface of the softened or melted toner is cohesive. The cohesiveness enables the softened or the melted toner to adhere to a recording medium.

Accordingly, a melting point or a softening point of a resin in the toner needs to be equal to or lower than temperature of the heat-fixing in the image-fixing apparatus. A toner whose resin has a melting point or a softening point equal to or lower than temperature of the heat-fixing is more likely to become deformed by external pressure. Deformation of the toner results in squash of the toner, and the image-reproducibility or image-fidelity deteriorates, as the image formed by the toner becomes larger than a latent image primarily developed. If the pressure is excluded from an image-fixing step, however, the image-fixing properties deteriorate because the toner insufficiently penetrates into a recording medium, and exhibits poor cohesiveness to the recording medium, although deformation of the toner is prevented and an image close to a latent image can be obtained.

The inventor of the present invention has conducted a research in order to achieve good image-fixing properties without deformation of toners. Consequently, it has been found out that it can be achieved by providing a toner for electrophotography having the following configurations. The toner is configured to comprise a coloring agent, a binder resin which contains cyclized rubber, and wax. The toner is also configured that the cyclized rubber contains cis1,4-polyisoprene at a portion excluding a cyclized portion of the cyclized rubber. The toner is further configured that the cyclized rubber contains 30% or more of the cis1,4-polyisoprene in a number ratio of an isoprene monomer unit at a portion excluding a cyclized portion of the cyclized rubber. The toner is still further configured to contain 10% by weight or more of the cyclized rubber, relative to the binder resin. The toner is also configured that a cyclization degree of the cyclized rubber is 40% or more. The toner is still further configured that a weight average molecular weight (Mw) of the cyclized rubber is $1\times10^3$ to $5\times10^5$.

The term, "cyclized rubber," refers to rubber which contains cyclized portion.

A content of the cis1,4-polyisoprene can be measured by, for example, nuclear magnetic resonance (NMR) with Tetramethylsilane (TMS) standard, or the like.

The term, "cyclization degree," refers to a content of cyclized isoprene monomer unit, relative to isoprene monomer units in a whole portion including a cyclized portion of the cyclized rubber.

The cyclization degree can be measured by, for example, NMR with TMS standard, by IR spectroscopy with pellet method, or the like.

The needle penetration of the wax can be measured by ASTM (American Society for Testing and Material) D-1321 at 25° C., or the like.

The weight average molecular weight (Mw) can be measured by GPC with styrene conversion, or the like.

Exhibiting a rubber elasticity, cis1,4-polyisoprene helps a toner get back to its original formation from deformation, after the toner is once squashed during heating and pressurizing, penetrates into a recording medium and obtains cohesiveness.

Cis1,4-polyisoprene may be obtained from a natural product or can be obtained by synthesizing C5 fraction. A natural product includes various impurities such as protein, saccharine, or the like. The more impurities the natural product includes, the more significantly the elasticity of cis1,4-polyisoprene deteriorates. Synthesizing cis1,4-polyisoprene 100% causes a problem of having trans1,4-bond, 3,4-bond, or 1,2-bond in addition to cis1,4-bond. The inventor of the present invention have found out that a ratio of the impurities excluding the cis1,4-isoprene monomer unit in a number ratio of a monomer unit of 70% or less excluding the cyclized portion sufficiently enables the cis1,4-polyisoprene to have a desirable rubber elasticity. In the other words, 30% or more in a number ratio of a monomer unit of a content of cis1,4-isoprene sufficiently enables the desirable rubber elasticity. The content of cis1,4-isoprene is preferably 50% or more for the desirable rubber elasticity. It has also been found out that cis1,4-polyisoprene needs to be cyclized, as it is difficult to be compatible with other compositions. The inventor of the present invention has found out that cyclization degree of the cyclized rubber is preferably 40% or more, and more preferably 70% to 98%, so as to be uniformly dispersible and to be compatible. Weight average molecular weight (Mw) of the cyclized rubber is required to be $1\times10^3$ to $5\times10^5$. If the weight average molecular weight (Mw) is less than $1\times10^3$, the cyclized rubber becomes excessively fragile and over-pulverized, and is unable to be used for a toner having a desirable particle diameter. If the weight average molecular weight (Mw) is more than $5\times10^5$, the cyclized rubber becomes excessively tough, and a desirable toner cannot be manufactured.

The weight average molecular weight (Mw) is more preferably $1\times10^4$ to $3\times10^5$.

If a content of the cyclized rubber is less than 10% by weight relative to the total weight of the binder resin, the desirable rubber elasticity is less likely to be obtained. When the cyclized rubber is used together with other resin, the content of the cyclized rubber is preferably 15% by weight to 90% by weight, and more preferably 20% by weight to 60% by weight, relative to the total weight of the binder resin.

Examples of wax contained in the toner of the present invention include paraffin wax, micro crystalline wax, olefin wax, carnauba wax, candelilla wax, montan wax, and the like. The above-listed wax is preferably compatible with the cyclized rubber. The wax preferably has a melt viscosity of 1 c poise to $10^7$c poise, more preferably 1 c poise to $10^5$c poise, and still more preferably 1 c poise to $10^3$c poise at 150° C. The above melt viscosity is considered to be preferable because the wax is more likely to become compatible with the other components of the toner at a lower elasticity.

A needle penetration of the wax is preferably 0 to 20, and more preferably 0 to 10, because a surface of the toner becomes elastic with excessively soft wax.

Image-fixing test was carried out with the toner thus prepared. A high quality image close to a latent image was obtained upon development.

A content of the wax in the toner is preferably 1 part by weight to 65 parts by weight, more preferably 3 parts by weight to 45 parts by weight, and still more preferably 5 parts by weight to 20 parts by weight, relative to 100 parts by weight of the binder resin.

There is no limitation on the coloring agent contained in the toner. Examples of the coloring agent include any of a pigment such as carbon black or the like; dyes, or the like, as long as it gives color.

An example of a process for manufacturing a cyclized isoprene includes Fisher's method.

In the Fisher's method, 5% by weight of concentrated sulfuric acid is mixed into one of natural rubber and isoprene rubber. Thereafter, the natural rubber or the isoprene rubber is heated for 15 hours at 130° C., so as to manufacture a cyclized isoprene.

Alternatively to the Fisher's method, a cyclizing agent such as organic sulfonic acid, tin chloride, iron chloride, nonmetal halide, halogenated primary sttanic acid, halogenated secondary sttanic acid, or the like, can also be used, and cyclized isoprene, which is a resinous thermosetting substance can be generated. In the manufacturing process, isomerization is induced by cyclizing catalyst, therefore, specific gravity is increased, and unsaturation is decreased in the rubber. An example of the isomerization is shown in the following Formula 1. It should be noted, however, that not whole portion of the cyclized isoprene is necessarily formed of cis1,4-bonds, and that not whole portion of the cyclized isoprene is necessarily cyclized. In this way, a compound having completely different properties is obtained.

Formula 1

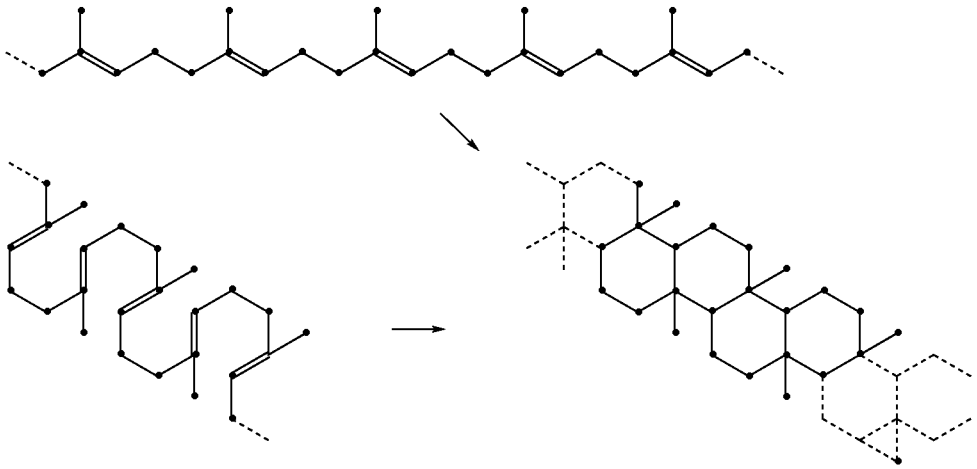

Examples of the binder resin can be selected from the following other resins in addition to the cyclized rubber, according to the purpose.

Examples of the binder resin include homopolymers of the styrene and substituents of the styrene such as polystyrene, poly p-chlorostyrene, poly vinyltoluene, or the like; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chrolomethacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, styrene-maleic acid ester copolymer, or the like; poly methyl methacrylate, poly butylmethacrylate, poly vinyl chrolide, poly vinyl acetate, polyester, polyurethane, polyamide, an epoxy resin, poly vinylbutyral, poly acrylic acid resin, rosin, modified-rosin, a terpene resin, an aliphatic or alicyclic hydrocarbon resin, an aromatic petroleum resin, chlorinated paraffin, and the like. These can be used either alone or in combination of two or more. The examples of the other resins are not limited to the aforementioned.

Carbon black or a color pigment can be mixed and dispersed in the binder resin. A charge control agent can also be used in combination with the binder resin.

An additive such as silica, titanium, strontium, or the like can be added to the toner after pulverized, in order to control fluidability of the toner.

The developer of the present invention comprises the toner for electrophotography of the present invention.

The image-forming process cartridge of the present invention includes an image-developer. The toner of the present invention is contained in the image-developer. The image-forming process cartridge of the present invention is formed in a one-piece construction, and can be attachable to and detachable from an image-forming apparatus. The image-forming process cartridge may further include a latent electrostatic image support, a light-irradiator, a cleaner, and the like, if necessary.

FIGURE is an example of a structure of an image-forming process unit (process cartridge) (106), having a photoconductor drum (101) which serves as the latent electrostatic image support, a charging roller (103), a cleaning apparatus (105) which serves as a cleaner and an image-developer (102) which serves as the aforementioned image-developer, all of these being formed in a one-piece construction which can be attached to and detached from an image-forming apparatus. The image-developer (102) has a development sleeve (104).

The image-forming apparatus of the present invention includes a latent electrostatic image support, a charger configured to uniformly charge the latent electrostatic image support, a light-irradiator configured to irradiate a light having a desirable pattern to the latent electrostatic image support so as to form a latent image, an image-developer configured to contain the toner of the present invention, and to develop the latent image with the toner so as to form a toner image, and a transfer configured to transfer the toner image from the latent electrostatic image support onto a recording medium.

The image-forming process of the present invention comprises the step of charging a latent electrostatic image bearing member; the step of irradiating light imagewisely to the latent electrostatic image bearing member so as to form an latent electrostatic image; the step of developing the electrostatic image using a toner so as to form a toner image; the step of transferring the toner image onto a recording material; and the step of fixing the toner image on a recording material so as to form an image. In the image-forming process of the present invention, the toner for electrophotography of the present invention is utilized as the toner.

The present invention will be described in more detail with reference to the following Examples and a Comparative Example. However, the present invention is not limited to those Examples and a Comparative Example. In the following Examples and a Comparative Example, "%" refers to "% by weight." Also, the cyclized rubber provided in the following Examples and a Comparative Example, was obtained by synthesis, so that cyclized rubber (cyclization degree: 80) where a content of cis1,4bonds in a number ratio of a monomer unit at a portion excluding a cyclized portion of the cyclized rubber, became 90%.

EXAMPLE 1

| | |
|---|---|
| Cyclized rubber (cyclization degree: 80) where a content of cis1,4 bonds is 90%, and a weight average molecular weight (Mw) is $1.4 \times 10^5$ | 80% (content) |
| Carnauba wax | 10% (content) |
| Carbon (Mitsubishi carbon black) | 9% (content) |
| CCA (zing salicylate) | 1% (content) |

An image was formed using Imagio 7070 produced by Ricoh Company, Ltd., and then image-fixing test was conducted. Thereafter, a toner dot of the thus fixed image and a toner dot of a non-fixed image were observed by a microscope. It was found out that the toner dot of the fixed image was not larger than the toner dot of a non-fixed image; and hence that an image which was almost the same as the latent image was obtained.

EXAMPLE 2

| | |
|---|---|
| Cyclized rubber (cyclization degree: 80) where a content of cis1,4 bonds is 90% and a weight average molecular weight (Mw) is $1 \times 10^4$ | 80% (content) |
| Olefin wax | 10% (content) |
| Carbon (Mitsubishi carbon black) | 9% (content) |
| CCA (zing salicylate) | 1% (content) |

Image-fixing test was conducted in the same way as in Example 1, resulting in obtaining an image which was almost the same as the latent image.

EXAMPLE 3

| | |
|---|---|
| Cyclized rubber (cyclization degree: 80) where a content of cis1,4 bonds is 90% and a weight average molecular weight (Mw) is $1.3 \times 10^4$ | 40% (content) |
| St-acrylic resin | 40% (content) |
| Carnauba wax | 10% (content) |
| Carbon (Mitsubishi carbon black) | 9% (content) |
| CCA (zinc salicylate) | 1% (content) |

Image-fixing test was conducted in the same way as in Example 1, resulting in obtaining an image which was almost the same as the latent image.

Comparative Example 1

| | |
|---|---|
| St-acrylic resin | 80% (content) |
| Carnauba wax | 10% (content) |
| Carbon (Mitsubishi carbon black) | 9% (content) |
| CCA (zing salicylate) | 1% (content) |

Image-fixing test was conducted in the same way as in Example 1. It was found out that a toner dot having a diameter of 42.3 $\mu$m of a non-fixed image became a toner dot having a diameter of 46.3 $\mu$m. The image used for the image-fixing test had 20% larger area than the latent image.

According to the present invention, an image which is not larger than a latent image, and is close to the latent image can be obtained, even if the toner is heated and pressurized.

What is claimed is:

1. A toner for electrophotography comprising:

a coloring agent;

a binder resin which contains cyclized rubber; and wax, wherein the cyclized rubber contains 30% or more of cis1,4-polyisoprene in a number ratio of an isoprene monomer unit at a portion excluding a cyclized portion of the cyclized rubber.

2. A toner for electrophotography according to claim 1, wherein the cyclized rubber contains 50% or more of the cis1,4-polyisoprene in a number ratio of an isoprene monomer unit at the portion excluding the cyclized portion of the cyclized rubber.

3. A toner for electrophotography according to claim 1, wherein the toner contains 10% by weight or more of the cyclized rubber, relative to a total weight of the binder resin.

4. A toner for electrophotography according to claim 3, wherein the toner contains 15% by weight to 90% by weight of the cyclized rubber, relative to the total weight of the binder resin.

5. A toner for electrophotography according to claim 1, wherein a cyclization degree of the cyclized rubber is 40% or more.

6. A toner for electrophotography according to claim 5, wherein the cyclization degree of the cyclized rubber is 70% to 98%.

7. A toner for electrophotography according to claim 1, wherein a weight average molecular weight (Mw) of the cyclized rubber is $1\times10^3$ to $5\times10^5$.

8. A toner for electrophotography according to claim 1, wherein the weight average molecular weight (Mw) of the cyclized rubber is $1\times10^4$ to $3\times10^5$.

9. A toner for electrophotography according to claim 1, wherein the wax is at least one selected from paraffin wax, micro crystan wax, olefin wax, carnauba wax, candelilla wax, and montan wax.

10. A toner for electrophotography according to claim 1, wherein the wax has a needle penetration of 20 or less at 25° C.

11. A toner for electrophotography according to claim 1, wherein the wax has a needle penetration of 0 to 10 at 25° C.

12. A toner for electrophotography according to claim 1, wherein the wax has a melt viscosity of 1 c poise to $10^7$ c poise at 150° C.

13. A toner for electrophotography according to claim 1, wherein the wax has a melt viscosity of 1 c poise to $10^5$ c poise at 150° C.

14. A toner for electrophotography comprising:

a coloring agent;

a binder resin which contains cyclized rubber; and wax, wherein the cyclized rubber contains cis1,4-polyisoprene at a portion excluding a cyclized portion of the cyclized rubber, the cyclized rubber contains 30% or more of the cis1,4-polyisoprene in a number ratio of an isoprene monomer unit at a portion excluding a cyclized portion of the cyclized rubber, the toner contains 10% by weight or more of the cyclized rubber, relative to a total weight of the binder resin, a cyclization degree of the cyclized rubber is 40% or more, and a weight average molecular weight (Mw) of the cyclized rubber is $1\times10^3$ to $5\times10^5$.

15. A developer for electrophotography, comprising:

a toner, wherein the toner comprises:

a coloring agent;

a binder resin which contains cyclized rubber; and wax, wherein the cyclized rubber contains 30% or more of cis1,4-polyisoprene in a number ratio of an isoprene monomer unit at a portion excluding a cyclized portion of the cyclized rubber.

16. An image-forming process cartridge comprising:

an image-developer, wherein the image-forming process cartridge is formed in a one-piece construction, and is attachable to and detachable from an image-forming apparatus, the image-developer includes a toner for electrophotography, and the toner comprises:

a coloring agent;

a binder resin which contains cyclized rubber; and wax, wherein the cyclized rubber contains 30% or more of cis1,4-polyisoprene in a number ratio of an isoprene monomer unit at a portion excluding a cyclized portion of the cyclized rubber.

17. An image-forming apparatus comprising:

a latent electrostatic image support;

a charger configured to uniformly charge the latent electrostatic image support;

a light-irradiator configured to irradiate a light to the latent electrostatic image support so as to form a latent image;

an image-developer configured to have a developer and to supply the developer onto the latent image so as to develop the latent image and to form a toner image; and a transfer configured to transfer the toner image from the latent electrostatic image support onto a recording medium, wherein the developer contains a toner for electrophotography, and the toner comprises:

a coloring agent;

a binder resin which contains cyclized rubber; and wax, wherein the cyclized rubber contains 30% or more of cis1,4-polyisoprene in a number ratio of an isoPrene monomer unit at a portion excluding a cyclized portion of the cyclized rubber.

18. An image-forming process comprising the steps of:

charging a latent electrostatic image bearing member;

irradiating light imagewisely to the latent electrostatic image bearing member so as to form a latent electrostatic: image;

developing the electrostatic image using a toner so as to form a toner image;

transferring the toner image onto a recording material; and fixing the toner image on a recording material so as to form an image, wherein the toner comprises:

a coloring agent;

a binder resin which contains cyclized rubber; and wax, wherein the cyclized rubber contains 30% or more of cis1,4-polyisoprene in a number ratio of an isoprene monomer unit at a portion excluding a cyclized portion of the cyclized rubber.

* * * * *